US006991199B2

(12) United States Patent
Carpentier

(10) Patent No.: US 6,991,199 B2
(45) Date of Patent: Jan. 31, 2006

(54) POP-UP MECHANISM TO RAISE THE TOP OF PIECES OF FURNITURE

(76) Inventor: Guy Carpentier, 72, St-Anne, St-Anne de la Pérade, Quebec (CA) G0X 2J0

( * ) Notice: Subject to any disclaimer, the term of this patent is extended or adjusted under 35 U.S.C. 154(b) by 0 days.

(21) Appl. No.: 10/723,815

(22) Filed: Nov. 26, 2003

(65) Prior Publication Data

US 2004/0118326 A1 Jun. 24, 2004

Related U.S. Application Data

(60) Provisional application No. 60/430,123, filed on Dec. 2, 2002.

(51) Int. Cl.
*A47F 5/00* (2006.01)

(52) U.S. Cl. ..... 248/122.1; 248/281.11; 108/144.11; 108/147; 312/246; 312/319.1; 312/319.2; 312/319.3

(58) Field of Classification Search ..... 248/421, 248/281.11, 585, 157, 292.13, 122.1; 108/144.11, 108/147, 72, 65, 145, 141, 136, 146; 312/246, 312/319.1, 319.2, 319.3
See application file for complete search history.

(56) References Cited

U.S. PATENT DOCUMENTS 592,159 A 10/1897 Miller
775,731 A 11/1904 McCabe, Jr.
2,093,856 A 9/1937 Wales
2,356,924 A * 8/1944 Froelich ..... 108/6
2,531,140 A * 11/1950 Linde ..... 296/100.08
2,982,050 A * 5/1961 May ..... 108/2
3,472,183 A * 10/1969 Goodman ..... 108/147
3,710,735 A * 1/1973 Litvinoff et al. ..... 108/146
3,940,175 A 2/1976 Robison
4,194,452 A * 3/1980 Crowther et al. ..... 108/138
4,436,353 A 3/1984 Tucker
4,581,902 A 4/1986 Starck et al.
4,644,875 A * 2/1987 Watt ..... 108/93
4,817,220 A * 4/1989 Guttormsem ..... 5/611
4,898,103 A * 2/1990 Pontoppidan et al. ..... 108/145
5,004,206 A * 4/1991 Anderson ..... 248/585
5,375,514 A * 12/1994 Dann, Jr. ..... 100/145
5,410,971 A * 5/1995 Golden et al. ..... 108/6
5,503,086 A * 4/1996 Hoffman et al. ..... 108/138
6,038,986 A * 3/2000 Ransil et al. ..... 108/145

* cited by examiner

*Primary Examiner*—Kimberly Wood

(57) ABSTRACT

A pop-up mechanism working in parallel pairs used for lifting the tabletop part of a piece of furniture has a pair of cantilever arms joined together by an upper oblong member and a lower oblong member, both said upper oblong member and lower oblong member being parallel relative to each other and each being rotationally attached to opposite ends of said pair of cantilever arms.

1 Claim, 2 Drawing Sheets

POP-UP MECHANISM TO RAISE THE TOP OF PIECES OF FURNITURE

This application claims priority based on provisional patent application No. 60/430,123 filed on Dec. 2, 2002

BACKGROUND OF THE INVENTION

1. Field of the Invention

This invention relates to the field of fold out or pop-up tables in general but more particularly to a mechanism integrated into a piece of furniture to make its top pop-up.

2. Background

Over the years a number of inventions have concerned themselves with the integration of a table with a trunk or similar types of boxlike containers. In one instance, a container normally found inside the trunk is taken out, articulated in such a way so as to change its shape into a tabletop which sits atop the trunk. Other inventions have the tabletop folding upward and outward after the trunk lid is opened, sometimes integrating the table top with the interior side of the trunk lid. Other patents disclose more far out concepts such as U.S. Pat. No. 3,940,175 by Robinson which discloses a small trailer which converts into a picnic table and U.S. Pat. No. 4,581,902 by Starck which discloses a tabletop over a portable cooler.

These inventions do not provide the same functionality nor do they provide the same advantages as the invention disclosed herein.

SUMMARY OF THE INVENTION

It is a first object of the present invention to provide a piece of furniture with a pop-up tabletop.

It is a second object of the present invention to provide for a pop-up mechanism that is reliable and easy to use.

It is a third object of the present invention to provide for a pop-up mechanism which is compact and can be shipped economically to provide a cost advantage in marketing costs.

It is a final object of the present invention to provide for a pop-up mechanism that requires minimal effort on the part of the user to move the tabletop from one position to another.

In order to do so, the tabletop is also the top of the trunk, chest or other box like piece of furniture and it moves upward and laterally in an offset position relative to the trunk using a system of cantilevered arms. The word piece of furniture is used here to represent any type of furniture, box or container.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF THE PREFERRED EMBODIMENT

A pop-up mechanism 10, usually found in pairs with one mechanically fastened to one side of a piece of furniture 26 and the other fixedly attached to an opposite side so that they are parallel to each other.

Figure 1:
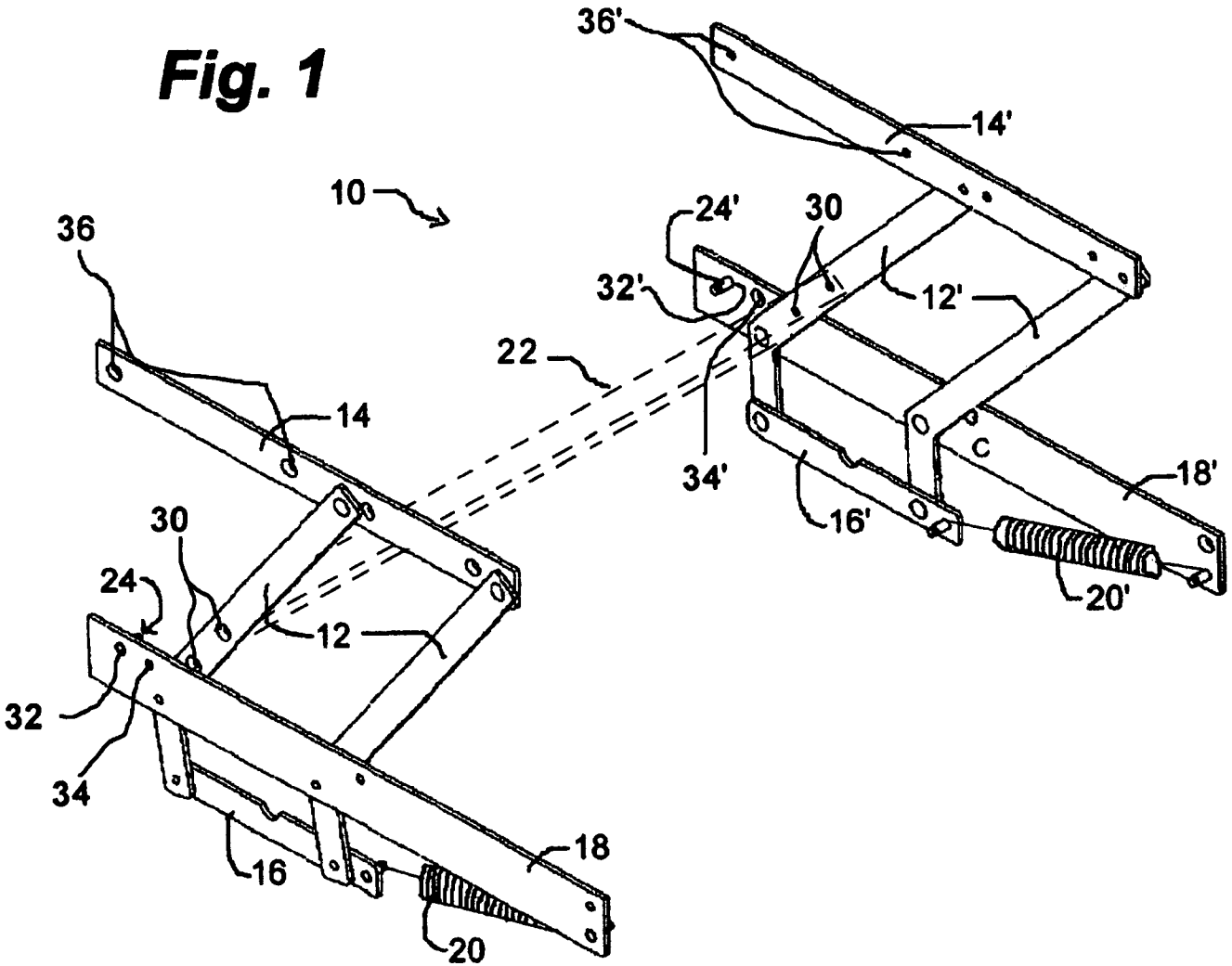
FIG. 1 Is a perspective elevational view of a pair of pop-up mechanisms.
Figure 2:
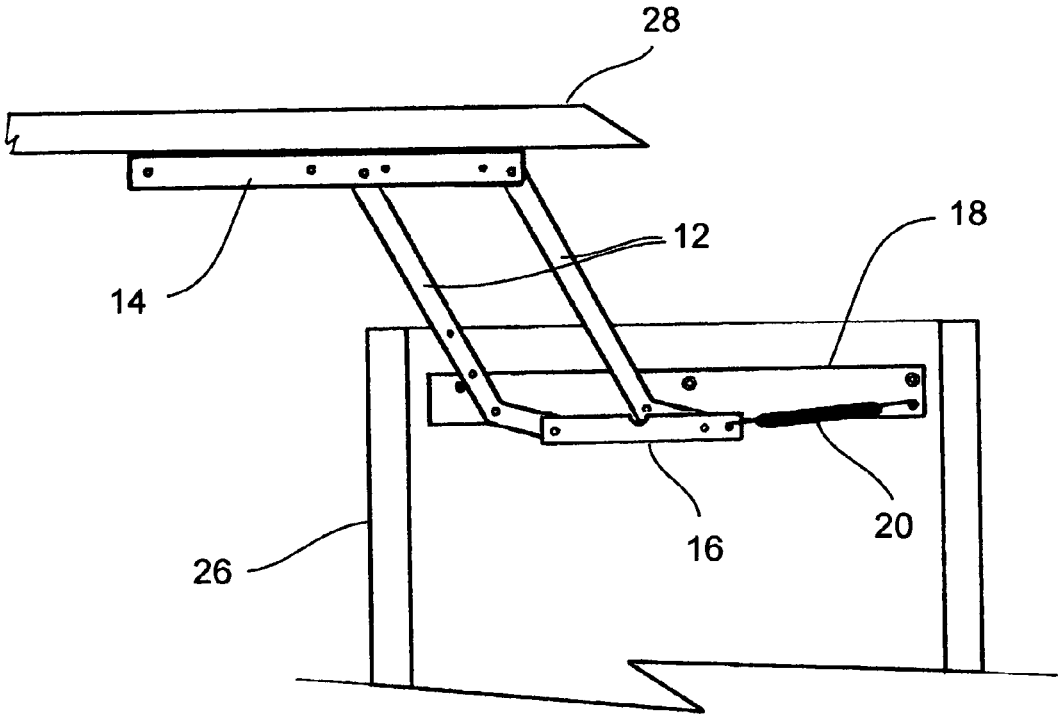
FIG. 2 Is a side elevational view of a piece of furniture where the pop-up mechanism is in an open configuration with the top of the piece of furniture raised.
Figure 3:
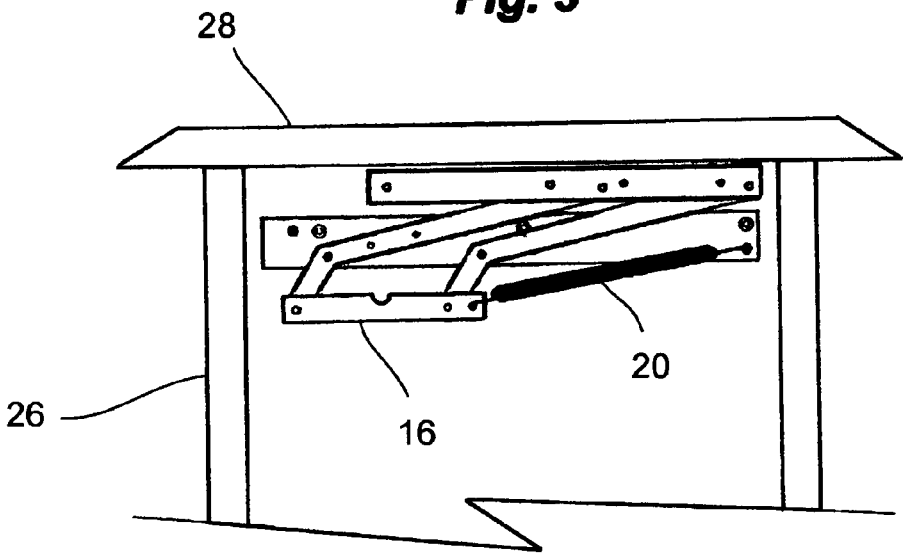
FIG. 3 Is a side elevational view of a piece of furniture where the pop-up mechanism is in an closed configuration with the top of the piece of furniture lowered.

Each pop up mechanism 10 has a pair of cantilever arms 12, 12' which are joined together by an upper oblong member 14,14' and a lower oblong member 16,16' both being parallel relative to each other and each being rotationally attached to opposite ends of the pair of cantilever arms 12, 12'. The pair of cantilever arms 12, 12' is further rotationally engaging a brace 18, 18' which is fixedly attached to one side of a piece of furniture 26 (FIGS. 2–3). A biasing means 20, 20' connects one point of the brace 18, 18' to one point of the lower oblong piece 16, 16' in order to provide a near zero force requirement for lifting a tabletop 28. The two pop-up mechanisms 10 are joined together by way of a cross bar 22 (dotted lines) which is normally mechanically fastened to the cantilever arms 12, 12' using predrilled holes 30, 30' to pass mechanical fasteners. The cross bar 22 thus installed allows for each otherwise separate pop up mechanisms 10 to work in unison and is selected by a craftsman during final assembly of the pop-up mechanism 10 according to the size of the piece of furniture 26 and also, to some extent to provide a match in wood essence with the rest of the piece of furniture. The cross bar 22 is not essential to the workings of the pop up mechanism 10 but it does help in making it work more reliably. By providing with only a pair of pop-up mechanisms 10, without the cross bar 22 an economy in shipping can be achieved.

A pair of stoppers 24, 24' inserted into stopper holes 32, 32' situated on the braces 18, 18' stop the cantilever arms 12, 12' so that they can come to a rest at a given position. That position can be changed by repositioning the stoppers 24, 24' into a different stopper hole 34, 34'. Each of the cantilever arm 12, 12' is shaped like a hockey stick which allows the pop-up mechanism 10 full motion as well as to reduce the stress on the biasing means 20, 20'. The upper oblong members 14, 14' have predrilled top fasteners holes 36, 36' through which mechnical fasteners pass in order to connect with wooden braces (not shown) themselves being part of the tabletop 28. The upper oblong members 16, 16' could alternatively be <<L>> shaped so that the part making contact with the tabletop 28 would have predrilled holes to pass mechanical fasteners therethrough.

In FIG. 2, the tabletop 28 is in its fully raised and extended configuration where it is resting in an overhanging, offset position in relation to the piece of furniture 26. In FIG. 3, the tabletop 28 is in the lowered position. The tabletop 28 can be used as part of a coffee table where it generally lies low and unobtrusively to then be raised and brought closer to the user due to its being offset. It can also be used in a bedroom in lieu of a nightstand since the tabletop 28 only needs to be brought near a bed when in use and is otherwise set some distance away from the bed.

What is claimed is:

1. A pop-up mechanism working in parallel pairs used for lifting a tabletop part of a piece of furniture and comprising:

a pair of cantilever arms joined together by an upper oblong member and a lower oblong member, both said upper oblong member and lower oblong member being parallel relative to each other and each being rotationally attached to opposite ends of said pair of cantilever arms;

said pair of cantilever arms being further rotationally engaging a fixed brace for attachment to said piece of furniture;

a biasing means connecting one point of said brace to one point of said lower oblong piece to provide a near zero force requirement for lifting said tabletop;

predrilled holes to pass mechanical fasteners for holding a cross bar generally added during final assembly of said pop-up mechanism;

stoppers situated on said brace to stop said cantilever arms so that they can come to a rest at a given position;

said stoppers can be changed in position by repositioning said stoppers into different stopper holes.

* * * * *